US005915538A

United States Patent [19]

Basson et al.

[11] Patent Number: 5,915,538

[45] Date of Patent: Jun. 29, 1999

[54] PROTECTIVE HELMET AND CHIN STRAP ATTACHMENT DEVICE THEREFOR

[75] Inventors: Gilles Basson, Chatillon-sur-Chalaronne; Jean-Paul Noyerie, Abergement Clemencis, both of France

[73] Assignee: Gallet S.A., Chatillon-sur-Chalaronne, France

[21] Appl. No.: 08/860,466

[22] PCT Filed: Dec. 29, 1995

[86] PCT No.: PCT/FR95/01760

§ 371 Date: Jul. 15, 1997

§ 102(e) Date: Jul. 15, 1997

[87] PCT Pub. No.: WO96/21369

PCT Pub. Date: Jul. 18, 1996

[30] Foreign Application Priority Data

Oct. 9, 1995 [FR] France ..... 95 00339

[51] Int. Cl.[6] ..... A42B 3/08

[52] U.S. Cl. ..... 2/421; 24/615; 24/625

[58] Field of Search ..... 2/6.1, 6.2, 410, 2/411, 421, 422, 424; 24/197, 625, 615

[56] References Cited

U.S. PATENT DOCUMENTS

| | | | |
|---|---|---|---|
| 840,655 | 1/1907 | Pellew | 24/625 |
| 2,867,812 | 1/1959 | Roth et al. | 2/6.2 |
| 4,110,847 | 9/1978 | Dera | 2/421 |
| 4,464,799 | 8/1984 | Nava | 2/421 |
| 4,774,744 | 10/1988 | Kasai | 24/625 |
| 4,928,365 | 5/1990 | Kasai | 24/625 |
| 5,003,632 | 4/1991 | Claude | 2/6.2 |
| 5,203,034 | 4/1993 | Foehl | 2/421 |

FOREIGN PATENT DOCUMENTS

| | | | |
|---|---|---|---|
| 77015 | 4/1983 | European Pat. Off. | 2/421 |
| 279398 | 6/1990 | Germany | 2/421 |

*Primary Examiner*—Michael A. Neas
*Attorney, Agent, or Firm*—Greenblum & Bernstein P.L.C.

[57] ABSTRACT

A device is provided for attaching a chin strap to a protective helmet that includes a main outer shell, and the device is of the type including a removable and disconnectable fastening device for the chin strap. The fastening device includes a fastening member for affixing to the chin strap and is engageable with a fastening lug affixed to a wall of the helmet. The fastening member is configured to include a fastening portion affixed to a pivotable gripping lever, and the pivotable gripping lever is pivotable mounted on the fastening member. Additionally, the fastening lug affixed to the helmet wall includes a matching recessed portion for receiving the fastening portion. Furthermore, the gripping lever of the fastening member is mounted and journaled about a first axis on a retaining part for a strap of the chin strap, and the recessed portion of the fastening lug is open upwardly and is limited outwardly by an outer projecting portion that provides a retaining and fastening edge.

16 Claims, 10 Drawing Sheets

PROTECTIVE HELMET AND CHIN STRAP ATTACHMENT DEVICE THEREFOR

The present invention relates to a protective helmet, and more specifically to the device for attaching its chin strap.

Protective helmets have been customarily used for a long time in various fields, either professionally, as is the case for the military, police or firemen, or in private, as is the case for motorcyclists, rally or race car drivers.

Protective helmets are already known which are used in various fields and are worn by diverse users, such as cyclists, motorcyclists, firemen, skiers and others, such as aircraft and helicopter pilots. All of the current helmets, irrespective of their use, include a generally sphere-shaped rigid outer shell including a facial opening, and whose cavity thus formed includes protective and comfort padding elements adapted to nest the user's head. Furthermore, the helmet is conventionally maintained on the user's head by means of a flexible chin strap attached to the lateral portions of the helmet. The current devices for linking the chin strap are totally unsatisfactory, because inefficient, often unreliable, and are very anaesthetic; and removing or putting on the helmet is often quite difficult, and the chin strap is sometime unfastened at the wrong moment, the helmet then failing to perform its protective function properly.

The object of the present invention is to remedy these drawbacks by proposing a new chin strap connecting device which enables a particularly simple and rapid positioning and disconnection for the user, while ensuring a reliable and certain retention of the chin strap.

Thus, according to the invention, the device for attaching a chin strap to a protective helmet is of the type enabling a removable connection, and is characterized in that the chin strap fastening means are constituted by the cooperation of a fastening member affixed to the chin strap and engageable with a fastening lug affixed to the helmet wall.

According to a complementary characteristic of the invention, the fastening member is constituted by a cylindrical portion affixed to a pivotable gripping lever, whereas the fastening lug is constituted by a matching recessed portion.

According to another arrangement, latching means are provided for latching the gripping lever to the helmet, and especially to its lateral wall, in a disconnectable manner.

According to an embodiment, the gripping lever is pivotally mounted on a retaining part to which the chin strap is attached. Let's also note that the recessed portion constituting the fastening lug is open upwardly and closed at its ends by two end walls, and is limited outwardly by an outer projecting portion serving as a retaining and fastening edge, and toward the helmet wall by a rear wall, whereas the retaining edge is, in its central portion, interrupted by a central cutout adapted for the passage of the retaining end of the retaining part of the fastening member.

According to a preferred embodiment of the invention, the fastening lug is affixed to an independent edge part fixed on one of the lateral wall portions, and advantageously in the vicinity of the lateral edge of said lateral wall portion.

Of course, the invention also relates to the helmet equipped with the device. Furthermore, it must be noted that each of its lateral wall portions advantageously includes the device, which enables a total disconnection of the chin strap; but it could be otherwise, and the helmet could, for example, have only one removable connecting device arranged on only one side, while the chin strap would be irremovably fixed on the other side of the helmet.

Other characteristics and advantages of the invention will become apparent from the description that follows, with reference to the annexed drawings which are only provided by way of non-limiting examples.

Figure 1:
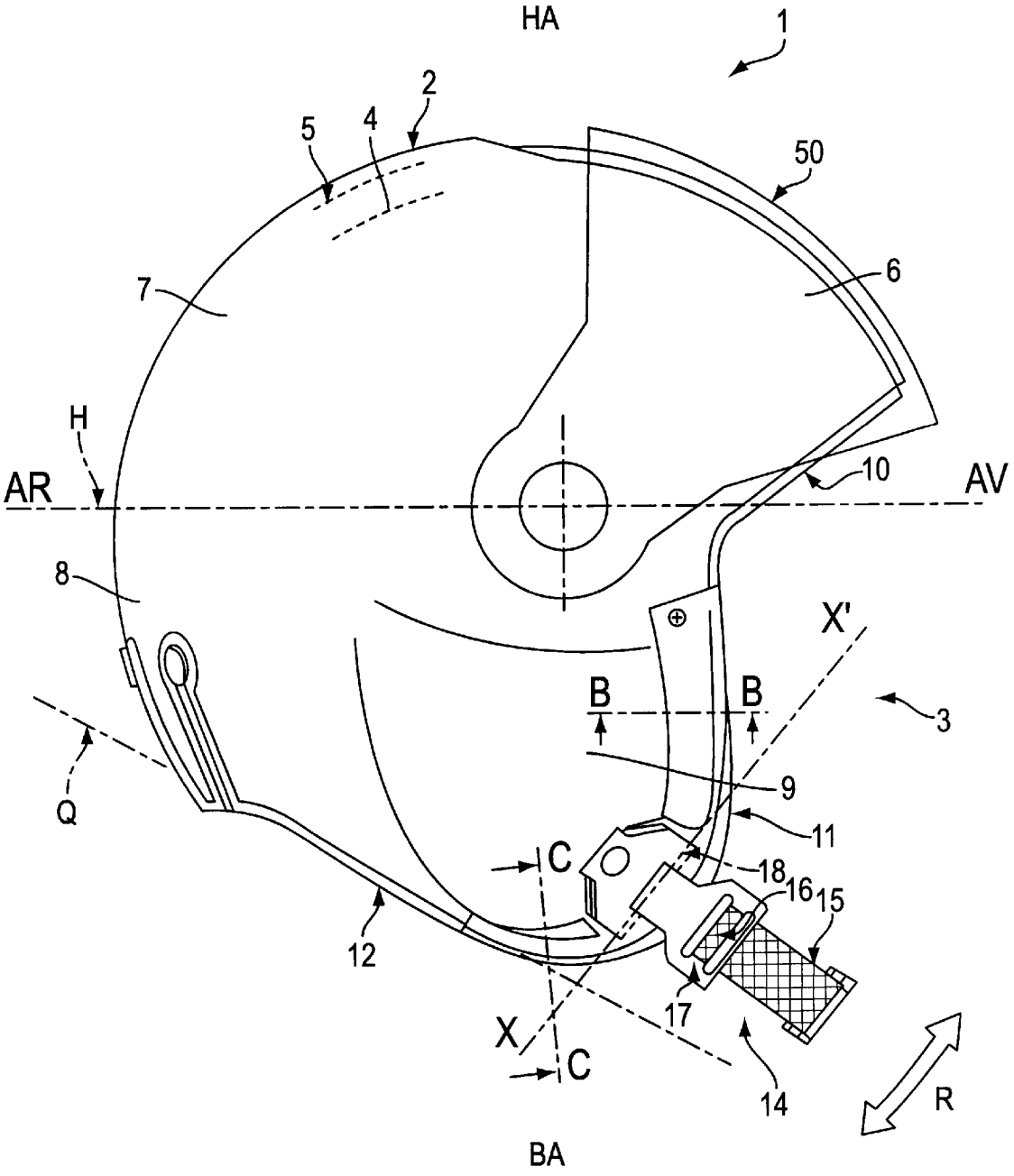
FIG. 1 is an external lateral view of a helmet according to the invention, with its chin strap.
Figure 2:
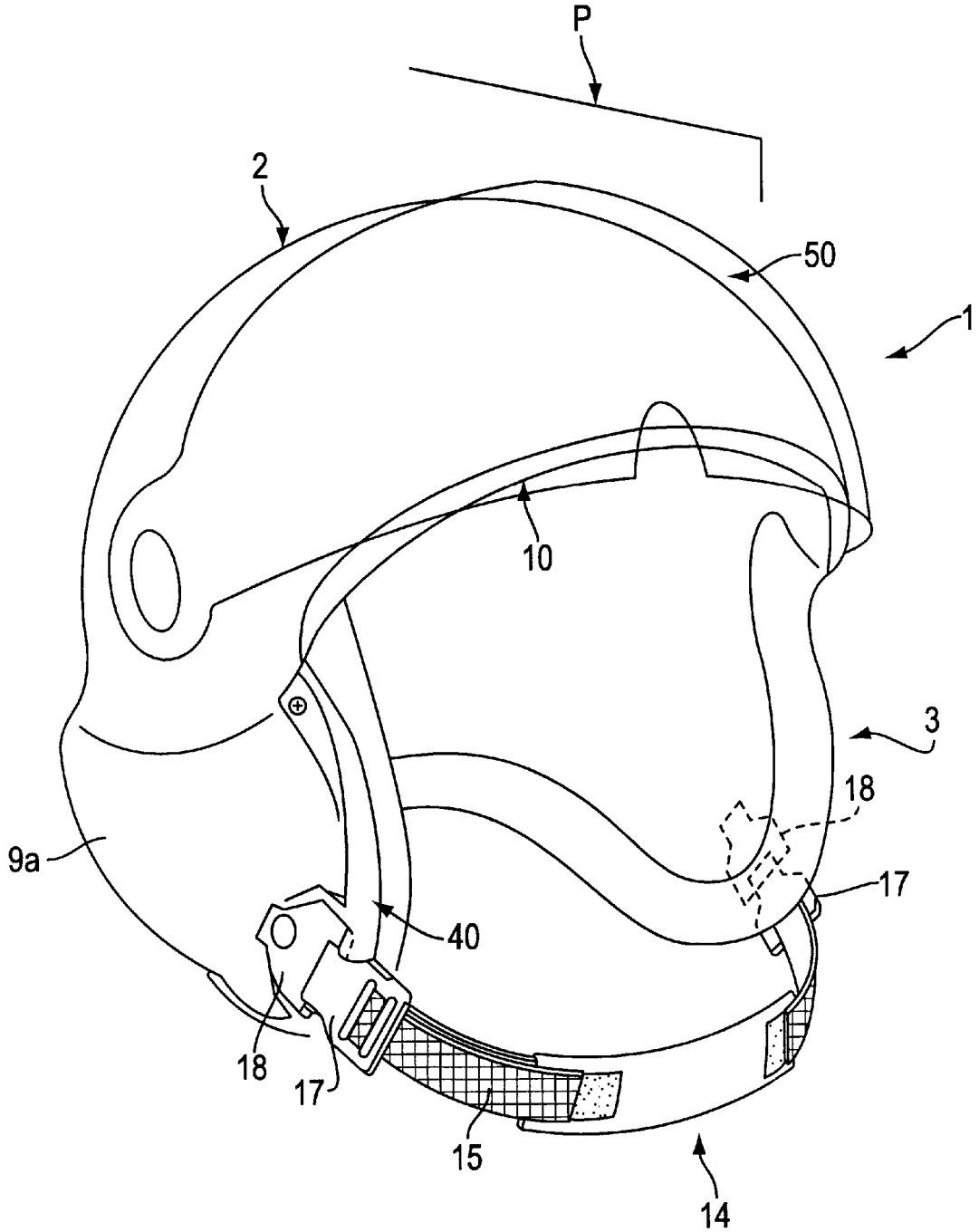
FIG. 2 is a perspective view of the helmet with its chin strap.
Figure 4:
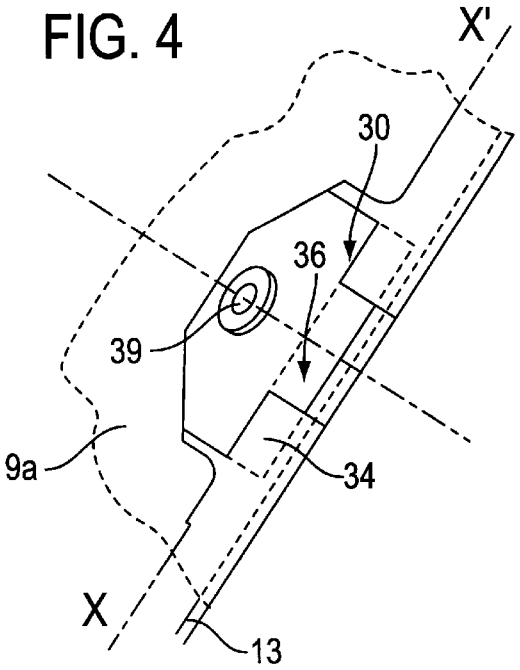
Figure 3:
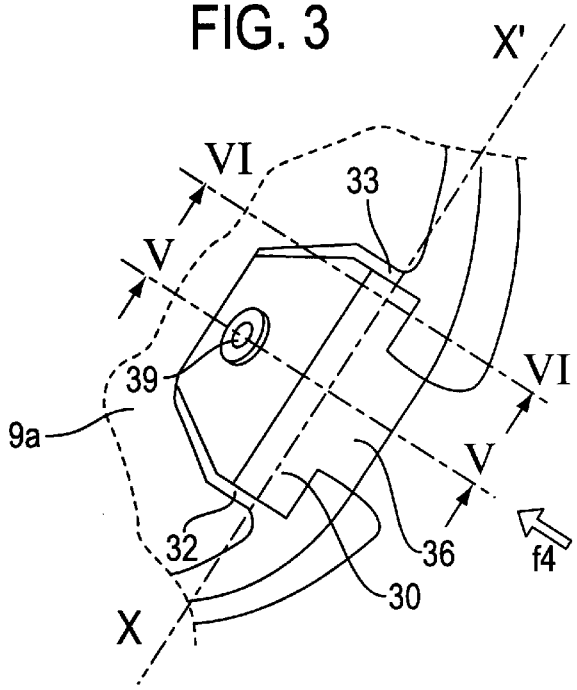
Figure 5:
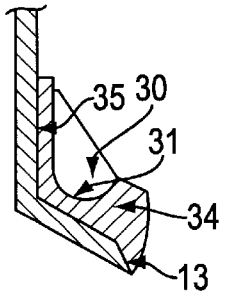
Figure 6:
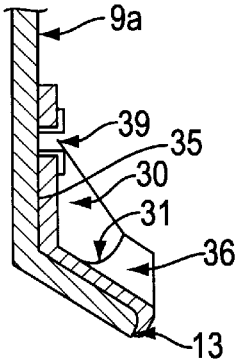
Figure 7:
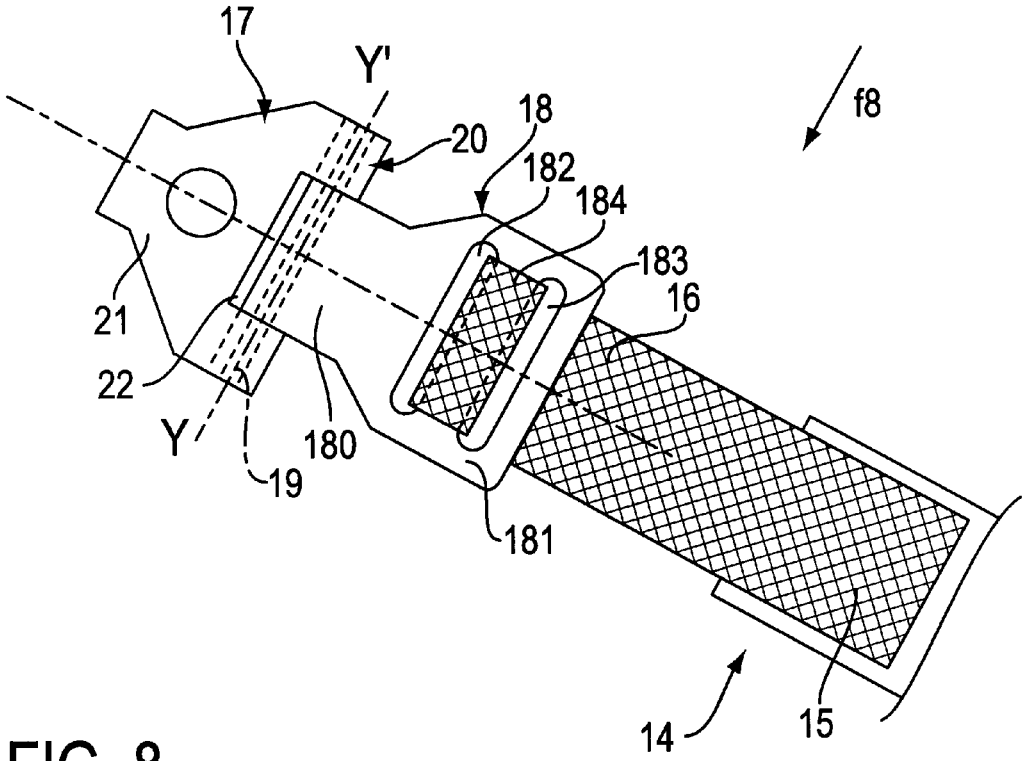
Figure 8:
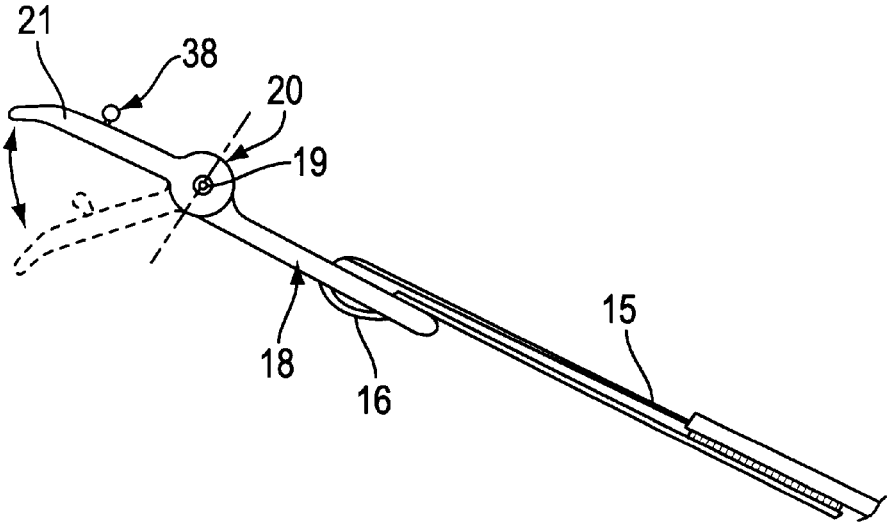
Figure 9:
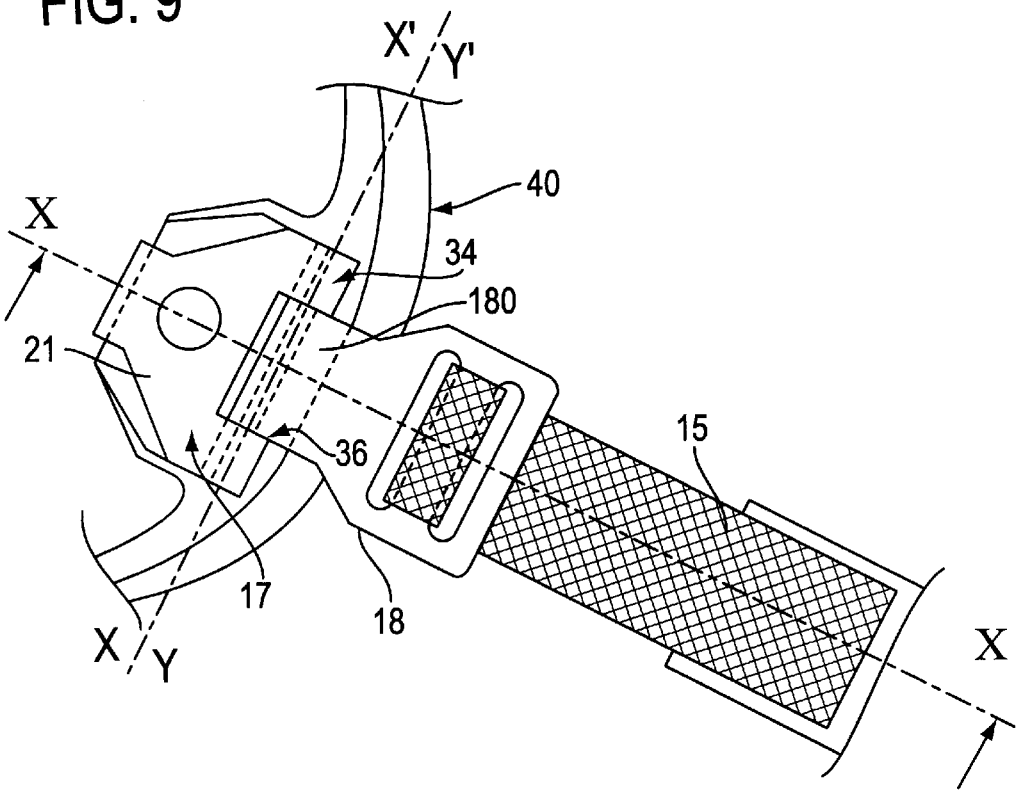
Figure 10A:
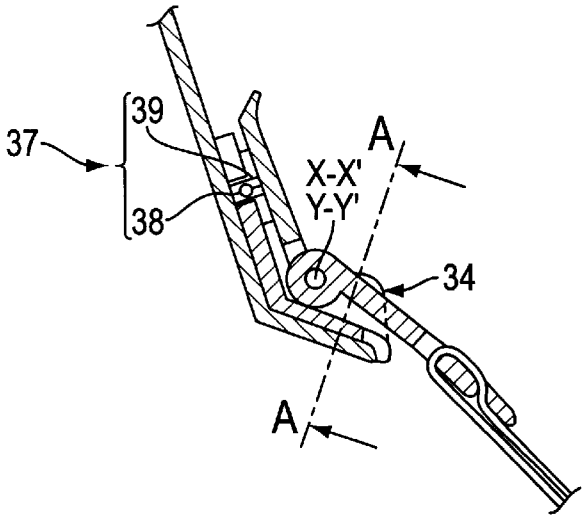
Figure 10B:
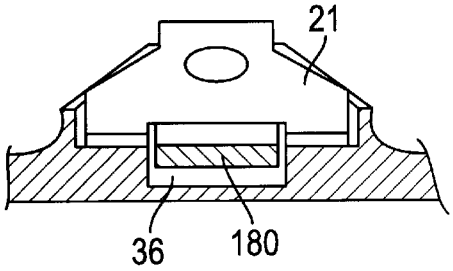
Figure 11:
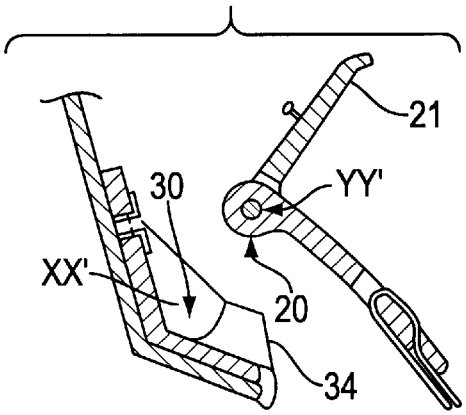
Figure 12:
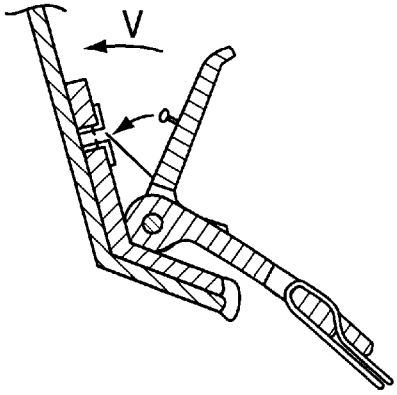
Figure 13:
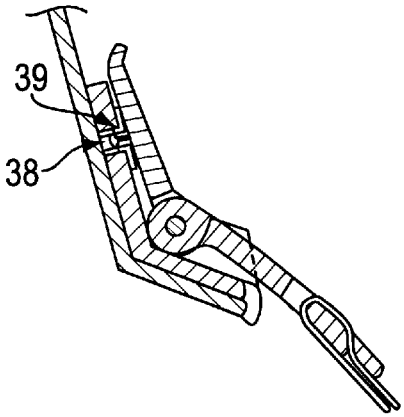
Figure 19:
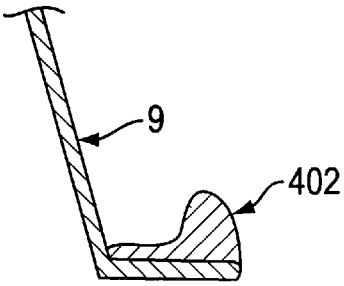
Figure 20:
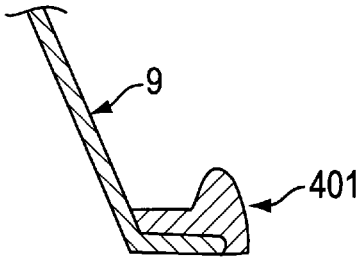
Figure 14:
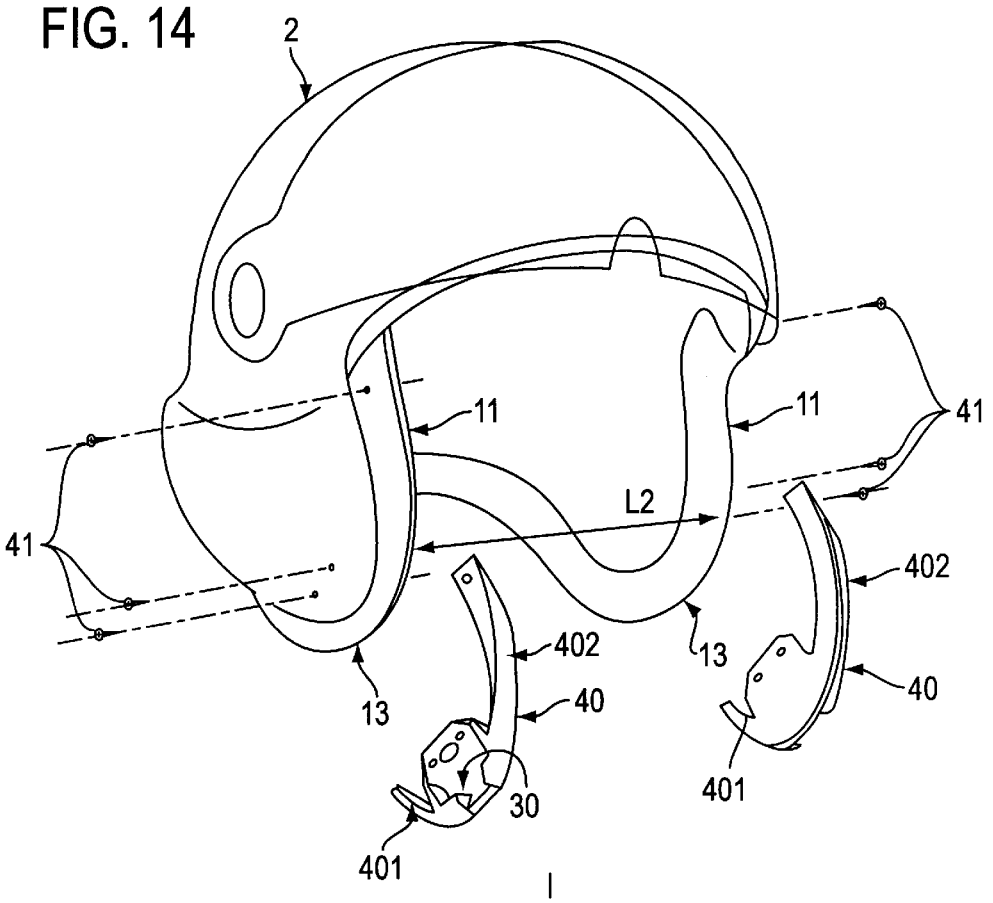
Figure 15:
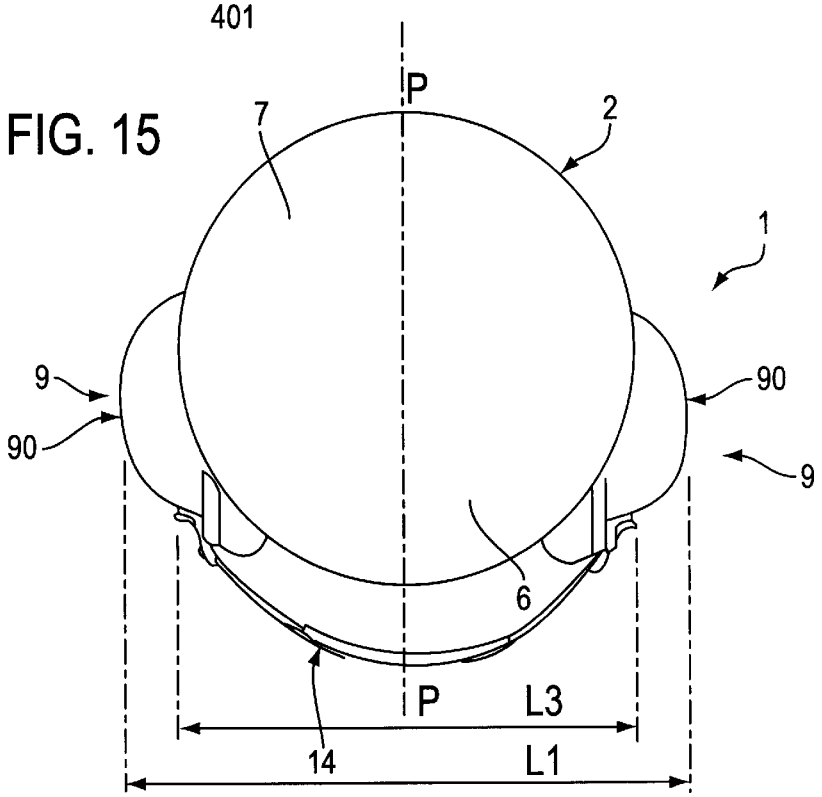
Figure 16:
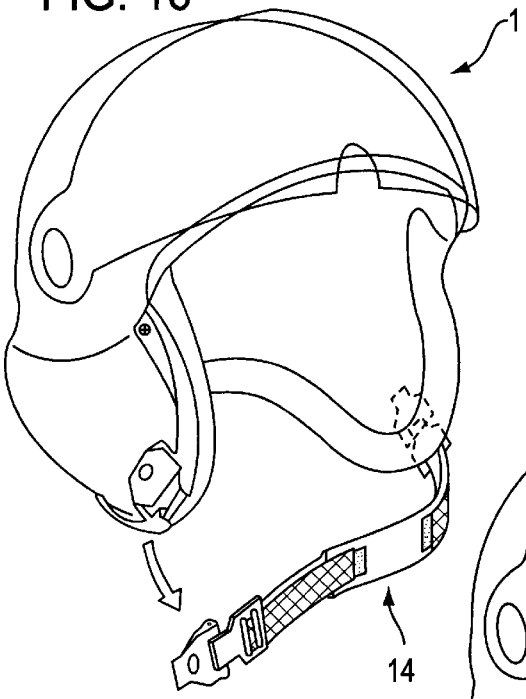
Figure 17:
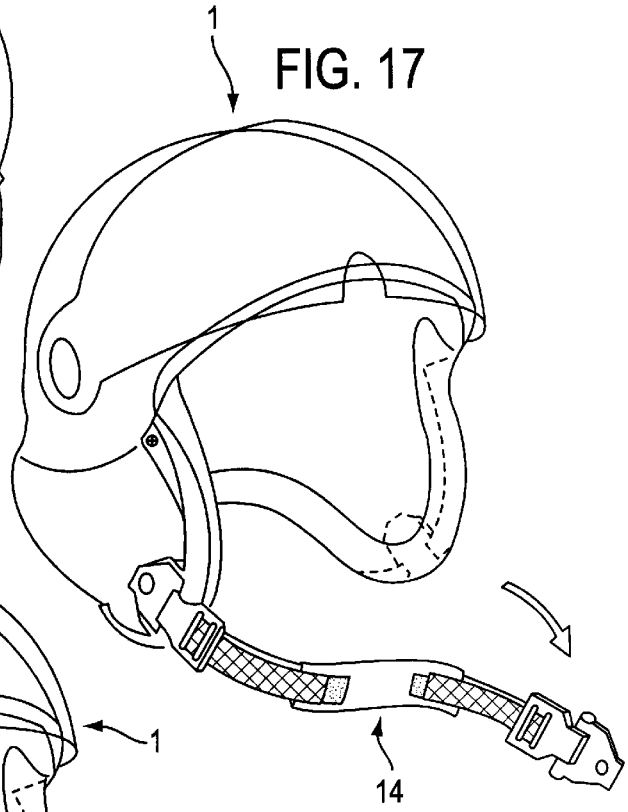
Figure 18:
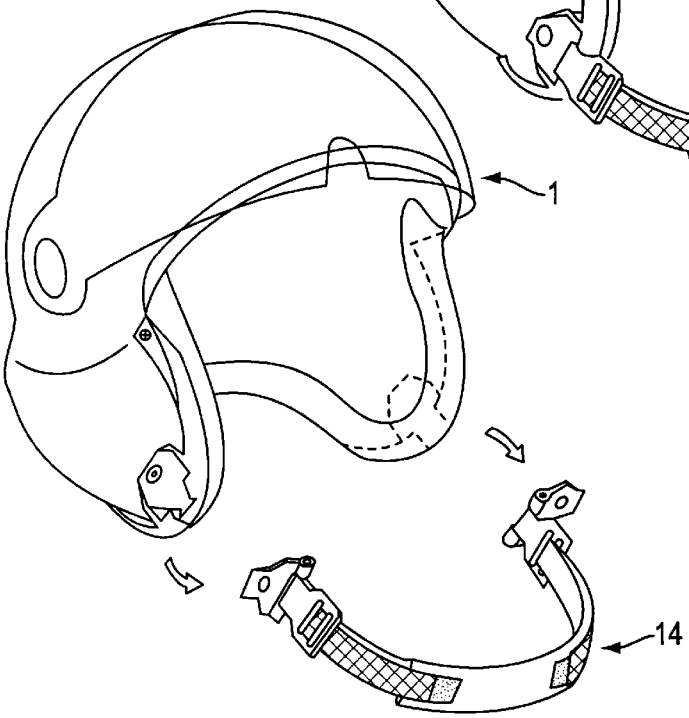
Figure 21:
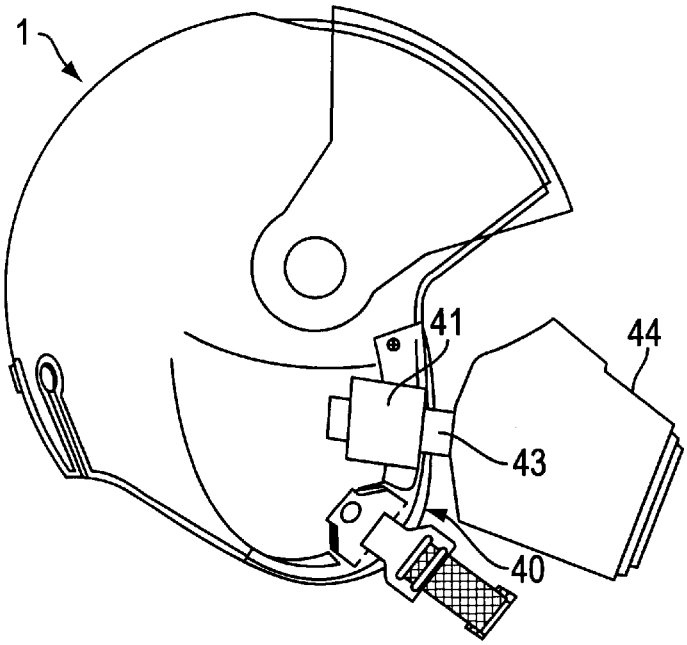
Figure 22:
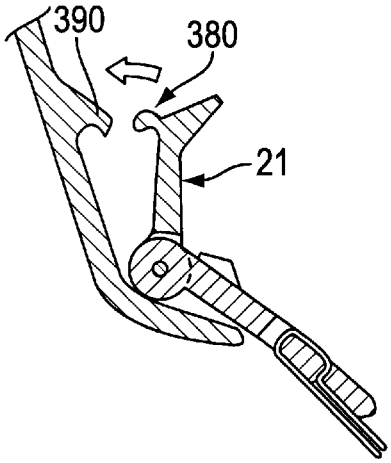
Figure 23:
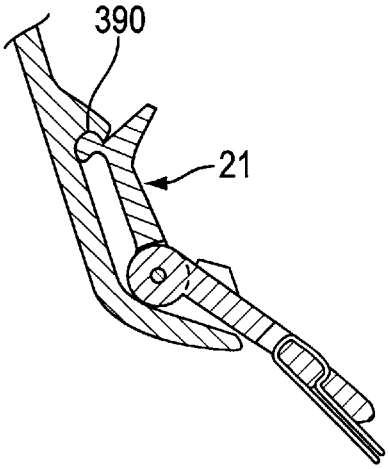
Figure 24:
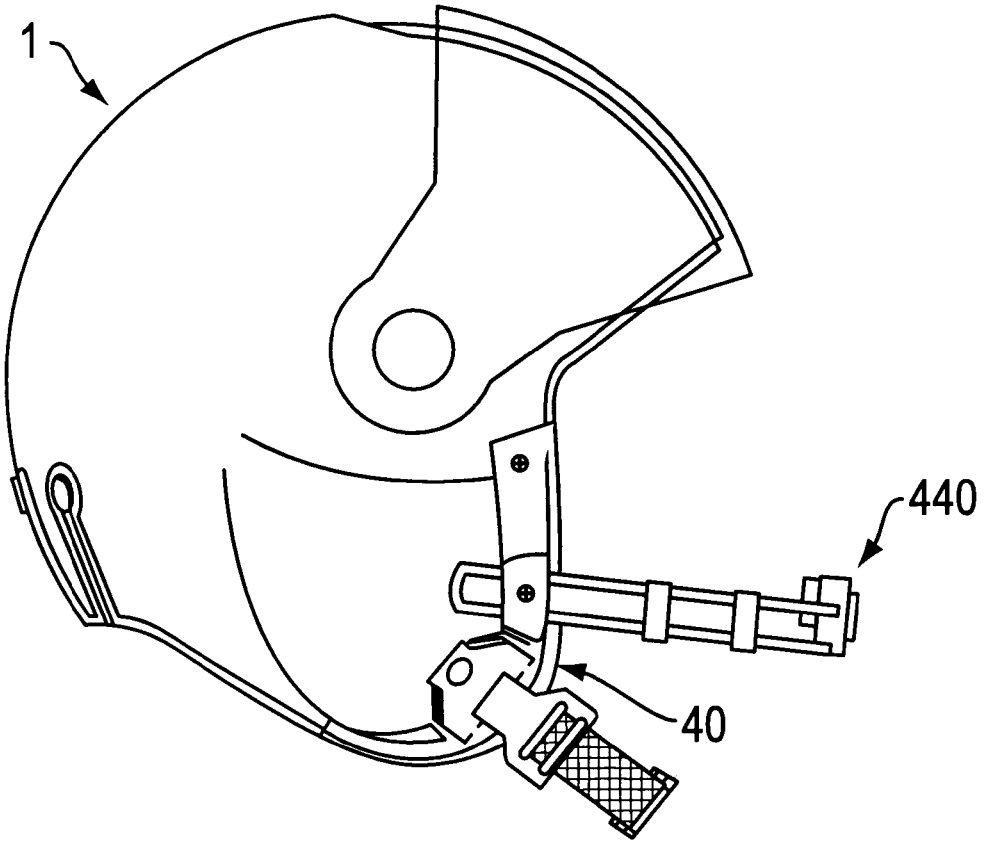

FIGS. 3, 4, 5, and 6 more particularly show the fastening lug affixed to the helmet;

FIG. 3 is a partial front view;

FIG. 4 is a view along f4 of FIG. 3;

FIG. 5 is a cross sectional view along V—V of FIG. 3;

FIG. 6 is a cross sectional view along VI—VI of FIG. 3;

FIGS. 7 and 8 show the end of the chin strap, with its fastening means, and in particular its fastening member adapted to cooperate with the fastening lug;

FIG. 7 is a planar view, whereas FIG. 8 is a lateral view along f8;

FIGS. 9 and 10 illustrate how the disconnectable removable connection occurs between the chin strap and the helmet;

FIG. 9 is a planar view, whereas FIG. 10*a* is a partial cross sectional view along X—X, FIG. 10*b* being a cross section along A—A;

FIGS. 11, 12, and 13 illustrate how the fastening of the chin strap occurs;

FIG. 14 is an exploded perspective view of the helmet without the chin strap, the edge parts having been removed;

FIG. 15 is a top view of the helmet with its chin strap;

FIGS. 16, 17 and 18 illustrate three ways of disconnecting the chin strap;

FIGS. 19 and 20 are cross sectional views along B—B and C—C, respectively, of FIG. 1, more particularly showing how the extension of the edge part is configured;

FIG. 21 shows an alternative embodiment in a lateral view;

FIGS. 22 and 23 are views similar to FIGS. 12 and 13 illustrating an alternative embodiment of the latching of the device;

FIG. 24 is a view similar to FIG. 21 showing another variation.

The protective helmet shown by way of example in FIGS. 1-18, generally designated by the reference (1) is especially a helmet for an aircraft pilot, which has a longitudinal general plane of symmetry (P) which includes, in a known manner, a main outer shell (2) having a front facial opening (3) with an internal padding commonly referred to as the upper part (4).

The main outer shell (2) is constituted by a substantially spherical wall (5) with a generally vertical plane of symmetry (P) that is advantageously made of a composite material of the type including a stacking of layers of reinforcing fibers impregnated and connected to one another by a resin matrix. The fibers can be glass, aramid, Nylon, polyethylene or carbon fibers, while the matrix can be a thermohardening or thermoplastic type of resin.

The main outer shell (2) includes a plurality of wall portions, namely, an upper front wall portion (6) extended rearwardly by an upper rear wall portion (7), which is itself extended downwardly by a lower rear wall portion (8), and further includes two lateral wall portions (9). The upper front wall portion (6) corresponds to the zone occupied by the forehead of the user and is limited by the upper edge (10) of the facial opening (3) which, in turn, is limited laterally by two lateral edges (11). The upper rear wall portion (7) corresponds to the zone occupied by the skull of the user, whereas the lower rear wall portion (8) corresponds to the zone occupied by the nape of the user. In addition, the wall (5) of the upper part is limited downwardly by a lower edge (12) extending in a general plane (Q) inclined with respect to the horizontal plane (H) to extend toward the rear (AR) and toward the top (HA). The lateral wall portions (9) correspond to the zones occupied by the ears of the user and are limited forwardly by the corresponding lateral edge (11) of the facial opening (3) and downwardly by the front ends of the lower edge (12). The connection between the lateral edges (11) and the lower edge occurs along an advantageously curved connecting edge (13).

The helmet of the invention includes a chin strap (14) removably held at the lateral wall portions (9) of the shell (2) of the helmet (1), and more particularly at the connecting edge (13) of each of said lateral wall portions (9).

The chin strap (14) is constituted by a flexible strap (15) bearing a fastening member (17) at its two ends (16). According to an arrangement of the invention, each of the fastening members (17) is pivotally arranged on a retaining part (18) by means of a transverse pin (19). The retaining part (18) is a substantially flat part including one retaining end (180) carrying the swivel pin (19) of the fastening member (17) and one enlarged end (181) including the retaining and adjusting means for the strap (15), which are constituted by two transverse cutouts (182, 183) separated by a crosspiece (184), said two transverse cutouts enabling the passage of the strap, as is known in itself.

The fastening member (17) includes a cylindrical portion (20) affixed to a gripping lever (21). The cylindrical portion (20) is interrupted in its central portion by a central cutout (22) adapted to receive the retaining end (180) of the corresponding retaining part (18).

The fastening member (17) of the chin strap (14) is adapted to cooperate with a fastening lug (30) affixed to the helmet (1), and more particularly to its main outer shell (2), and especially to its wall (5). According to an advantageous arrangement of the invention, the fastening lug (30) is arranged externally to the lateral wall portion (9) of the helmet wall (5) and in the vicinity of the wall edge (13). Let's note that the chin strap (14) is removable and can advantageously be totally or partially disconnected from the helmet itself, as we will see hereinafter. To this end, the chin strap attachment device is symmetrical, and each of the lateral wall portions (9) therefore includes a fastening lug.

Said fastening lug (30) is constituted by a recessed portion (31) adapted to cooperate with the cylindrical portion (20) of the corresponding fastening member (17). This recessed portion advantageously has a shape that is complementary to the contour of the fastening member. Thus, this recessed potion (31) is substantially cylindrical to extend along an (XX') axis parallel to the edge (13). The (XX') axis is inclined to extend toward the top (HA) and toward the front (AV) to form, with the horizontal (I), a forwardly open angle (A) having a value comprised between 30° and 60° and, for example, 40°.

Of course, the recessed portion (31) is open upwardly and advantageously closed at its ends by two end walls (32, 33), and is limited outwardly by a projecting outer portion (34) serving as a retaining and fastening edge, and toward the helmet wall by a rear wall (35). The retaining edge (34) is, in its central portion, interrupted by a central cutout (36) adapted to the passage of the retaining end (180) of the retaining part (18) of the fastening member (17). Let's note that the fastening lug (3) is arranged on the lateral wall portion (9) and advantageously in the vicinity of the lateral edge (11), and more particularly of the connecting edge (13).

According to a characteristic of the invention, disconnectable latching means are provided between the helmet and the fastening member, which means make it possible to ensure a particularly reliable fastening of the chin strap to the helmet, thus avoiding any ill-timed detachment, but which of course allow a particularly simple voluntary detachment. Thus, the fastening means are, for example, constituted by a clipping type of device or any other device. Therefore, as illustrated, one can provide a "snap fastener" type of device (37) of which one (38) of the elements is affixed to the lever (21) of the fastening member (17), whereas the other element (39) is affixed to the helmet or to the rear wall (35) of the recessed portion (31) of the fastening lug (30).

According to the invention, the fastening lug (30) for the fastening member of the chin strap (14) is affixed to an independent edge part (40) fixed to the helmet wall. This part (40) has the shape of a curved gutter and is, for example, made of an injected plastic material fixed to the lateral edge of the helmet by any means, such as screws (41), for example, and therefore includes the fastening lug (30, 31) with its end walls (32, 33) and its longitudinal walls (34, 35). Let's note that the edge part (40) not only has the technical functions mentioned previously, but also contributes to the aesthetic aspect of the helmet. Thus, the gutter (40) constituting the edge part extends not only in the zone of the fastening lug (30), but beyond, toward the connecting edge (13) to extend toward the lower edge (13) through a rear extension (401) to cover a portion of this lower edge, and toward the top through an extension (402) to cover the lateral edge (11).

Furthermore, the edge part (40) can be adapted to retain a respiratory mask, as is illustrated in FIG. 21. To this end, said edge part can include a retaining member (41) on which the end (42) of the retaining arm (43) of a respiratory mask (44) can be fixed. Furthermore, said edge portion (40) could also retain any element other than a respiratory mask, such as a microphone (440), for example, as is shown in FIG. 24.

It is understood that the helmet according to the invention can comprise one or more pivotable protective facial screens, as illustrated, for example, and bearing the reference (50).

FIGS. 11 and 13 illustrate how the fastening of the chin strap is carried out. To do this, the cylindrical portion (20) of the fastening member (17) is first positioned in the corresponding recessed portion (30) constituting the fastening lug of the helmet (FIGS. 11 and 12). In order to latch the fastening, the user only has to cause the gripping lever (21) to pivot toward the helmet wall along V, FIG. 14, to latch said lever by means of the latching means (37) so as to place the attachment device in the position illustrated in FIGS. 13, 9, 10, 1 and 2. In this position, the retention of the chin strap is particularly reliable while enabling a particularly simple disconnection for the user who only has to proceed in reverse by first causing the lever (21) to pivot outwardly, in order to be able to release the nesting made by the lug (30).

According to a preferred arrangement, the helmet is asymmetrical and includes attachment means for its chin strap on each side, which allows for the total disconnection of the chin strap, as is illustrated in FIG. 15, or for only a partial disconnection, and especially on only one side, right or left, as shown in FIGS. 16 and 17, respectively.

Let's note that the lateral wall portions (9) advantageously include projections (90) which internally form recesses adapted to receive the ears of the user, so that the remainder of the wall is closer to the lug of the latter. The overall width (L1) of the shell (2) of the helmet is therefore greater than the width (L2) between the two lateral edges (11) of the facial opening, as well as that between the two connecting edges (13). Because the fastening lugs (30) are arranged in the vicinity of the connecting edges (13), the width (L3) between such edges is less than the overall width (L1) of the outer shell (2). The chin strap fastening means therefore fit within the lateral space requirement of the helmet and are therefore protected, which prevents any undesired hooking of the lever (17) and therefore blocks any ill-timed release of the chin strap.

It is also advisable to note that the pivoting of the chin strap (14), as illustrated by the double arrow R in FIG. 1, is prevented by the fact that the retaining end (180) of the retaining part (18) is engaged in the central cutout (36) made in the retaining edge (34), as can be seen more particularly in FIGS. 1, 9, 10*a* and 10*b*.

Let's note also that the swivel pin (19) of the latching member (17) is preferably arranged in the zone of the fastening lug, such that its (YY') axis is positioned coaxially to the (XX') axis of said housing, i.e., beneath this latter (XX').

One will therefore note that the (YY') axis is advantageously arranged behind the retaining edge (34) of the fastening lug. Thus, even if the fastening member (17) is unlatched, an ill-timed detachment, due to the traction that might be exerted on the chin strap, cannot occur.

It is understood that any other embodiment can be considered, such as that illustrated schematically in FIGS. 22 and 23, for example. According to this one, the fastening lug is not constituted by an independent part fixed to the helmet wall, but is integral with the wall, so as to be injected with the latter, for example. Furthermore, the latching of the gripping lever (21) could be carried out through the elastic deformation of the constituent material of the parts, and especially the lever (21) which includes a deformable projection (380).

Let's add that the surface of the part or edge (40) in cooperation with the wall of the shell is substantial, which makes it possible to make a connection with glue; of course, this improves the resistance by reducing the risks of tear of the fabric of the wall. Indeed, use of a rivet or a screw would require bores which would create zones running risks of rupture. Therefore, due to a glue connection, a better distribution of the forces on the shell has been made possible, and it has therefore been made possible to make a shell with less fabric, while still offering the same safety quality.

Of course, the invention is not limited to the embodiments described and shown by way of examples, but it also includes all the technical equivalents as well as their combinations.

We claim:

1. Device for attaching a chin strap to a protective helmet including a main outer shell, said fastening device being of the type including a removable and disconnectable fastening device for its chin strap, said fastening device comprising:

a fastening member for affixing to the chin strap and engageable with a fastening lug affixed to a helmet wall wherein said fastening member is configured to include a fastening portion affixed to a pivotable gripping lever, said pivotable gripping lever is pivotable mounted on said fastening member, and wherein the fastening lug includes a matching recessed portion for receiving said fastening portion.

2. Device for attaching a chin strap to a protective helmet according to claim 1, wherein said gripping lever of said fastening member is mounted and journaled about a first axis on a retaining part for a strap of the chin strap is retained about an axis.

3. Device for attaching a chin strap to a protective helmet according to claim 2, wherein said recessed portion of said fastening lug is open upwardly and is limited outwardly by an outer projecting portion providing a retaining and fastening edge.

4. Device for attaching a chin strap to a protective helmet according to claim 3, wherein said first axis is arranged behind the retaining edge of the fastening lug.

5. Device for attaching a chin strap to a protective helmet according to claim 4, wherein said fastening member is configured as a cylindrical portion having said first axis, and wherein said fastening lug is formed by a matching cylindrical recessed portion having a second axis.

6. Device for attaching a chin strap to a protective helmet according to claim 5, wherein said first axis of said cylindrical portion is substantially coaxial with a swivel pin connecting said fastening member to said retaining part and to said second axis of the recessed portion.

7. Device for attaching a chin strap to a protective helmet according to claim 3, wherein said retaining edge is, in its central portion, interrupted by a central cutout adapted for passage of a retaining end of the retaining part of the fastening member.

8. Device for attaching a chin strap to a protective helmet according to claim 1, wherein a latching mechanism is provided for latching the gripping lever to the helmet wall in a disconnectable manner.

9. Device for attaching a chin strap to a protective helmet according to claim 1, wherein said recessed portion of the fastening lug is closed at its ends by two end walls.

10. Device for attaching a chin strap to a protective helmet according to claim 1, wherein said recessed portion of the fastening lug is limited toward the helmet wall by a rear wall having a latching device for the lever.

11. Device for attaching a chin strap to a protective helmet according to claim 1, wherein said fastening lug is adapted to be affixed to an independent edge part fixed to the wall of the helmet.

12. Protective helmet including at least one attachment device according to claim 1, said helmet including a main outer shell having two lateral wall portions, wherein the fastening lug of the chin strap attachment device is arranged on one of the lateral wall portions.

13. Protective helmet according to claim 12, wherein said fastening lug is adapted to be affixed in the vicinity of a lateral edge of the lateral wall portion.

14. Protective helmet according to claim 1, wherein said fastening lug is adapted to be formed as an independent edge part fixed to a helmet edge.

15. Protective helmet according to claim 1, wherein said device includes an attachment device for the chin strap on each side of the chin strap.

16. A protective helmet having a main outer shell, and at least one fastening lug affixed to a wall of the helmet, in combination with a chin strap and a removable and disconnectable fastening device for the chin strap, said fastening device comprising:

a fastening member for affixing to the chin strap and engageable with said fastening lug, wherein said fastening member is configured to include a fastening portion affixed to a pivotable gripping lever, said pivotable gripping lever is pivotable mounted on said fastening member, and wherein said fastening lug includes a matching recessed portion for receiving said fastening portion of said fastening member.

* * * * *